United States Patent [19]

Kurtz

[11] Patent Number: 4,805,263

[45] Date of Patent: Feb. 21, 1989

[54] FINGER PULL

[76] Inventor: Thomas D. Kurtz, 510 Island View Rd., Rock Falls, Ill. 61071

[21] Appl. No.: 666,389

[22] Filed: Oct. 30, 1984

[51] Int. Cl.[4] ..... E05B 1/02

[52] U.S. Cl. ..... 16/124; 16/DIG. 7; 16/DIG. 24

[58] Field of Search ..... 16/124, DIG. 7, DIG. 12, DIG. 18, 16/DIG. 19, DIG. 24; 292/DIG. 38, DIG. 46

[56] References Cited

U.S. PATENT DOCUMENTS

| | | | |
|---|---|---|---|
| 610,135 | 8/1898 | Green | 16/124 |
| 1,761,582 | 6/1930 | Pelton | 16/124 |
| 2,447,389 | 8/1948 | Barchers | 16/110 R |
| 2,758,748 | 8/1956 | Konefes | 16/DIG. 24 |
| 3,012,293 | 12/1961 | Migneault et al. | |
| 3,077,011 | 12/1963 | Boucher | |
| 3,107,389 | 10/1963 | Engelbrecht | 16/124 |
| 3,117,339 | 1/1964 | Vigna | 16/124 |
| 3,156,021 | 11/1964 | Thompson | 16/124 |
| 3,382,526 | 5/1968 | Ryan et al. | 16/110 R |
| 3,524,215 | 8/1970 | Kurtz | |
| 3,881,758 | 5/1975 | Gross | 292/DIG. 46 X |
| 3,997,200 | 12/1976 | Brown | 292/DIG. 46 X |
| 4,114,934 | 9/1978 | Kelly | 16/124 |

*Primary Examiner*—Frank T. Yost
*Assistant Examiner*—James L. Wolfe
*Attorney, Agent, or Firm*—Vernon J. Pillote

[57] ABSTRACT

A finger pull for attachment to intersecting relatively transverse side and edge faces of a panel and which has a main base portion and an auxiliary base portion integrally connected along one edge of the main base portion. The main base portion has a flat mounting face at one side and the auxiliary base portion has a flat mounting face at one side that is disposed coplanar with the mounting face of the main base portion. A layer of pressure sensitive adhesive is adhered to the mounting faces of the main and auxiliary base portions and the connecting portion is made sufficiently thin to bend and allow the auxiliary base portion to be moved to a position extending transverse to the main base portion.

5 Claims, 1 Drawing Sheet

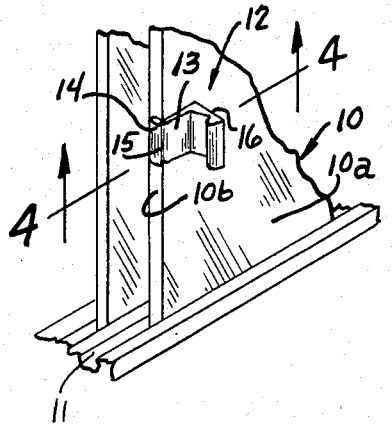
Fig. 1.
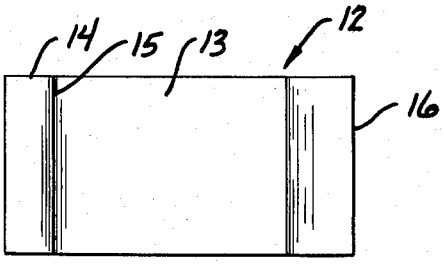
Fig. 3.
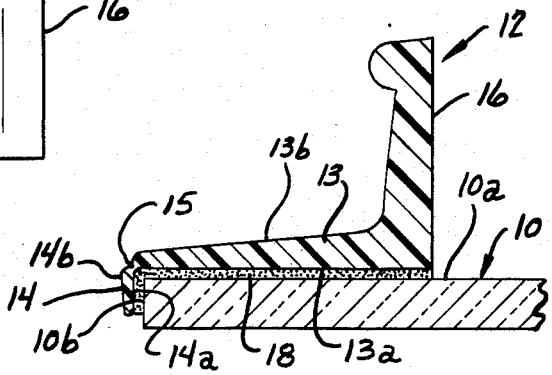
Fig. 4.
Fig. 2
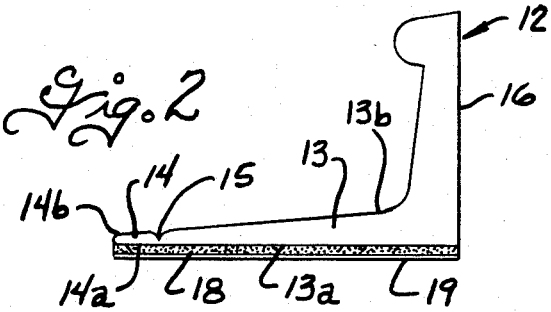

FINGER PULL

BACKGROUND OF THE INVENTION

Some finger pulls for glass panels have heretofore been made with a channel-shaped mounting portion for receiving the edge portion of the glass panel, for example as shown in U.S. Pat. Nos. 3,012,293 and 3,077,011. In mounting such finger pulls, it is necessary to slide the channel-shaped mounting portion onto the edge of the panel and the usual practice is to provide a layer of material having a high coefficient of friction between the channel and the edge of the glass panel to retain the finger pull on the panel. Such finger pulls are retained on the panel primarily by a mechanical gripping action and it is necessary to make the width of the channel closely correspond to the thickness of the panel. This requires finger pulls with different size mounting channels for different thickness glass panels. In addition, even when a layer of friction material is used between the mounting channel and the glass panel, glass chipping and breakage sometimes occurs due to localized pressure during mounting of the finger pull on the glass panel.

Finger pulls have also been made for glass panels which utilize a pressure sensitive adhesive on the back side of the finger pull to bond the finger pull to the face of the panel, for example as shown in the applicant's prior U.S. Pat. No. 3,524,215. However, in some installations it is desirable to provide a more secure attachment of the finger pull to the panel, than can be achieved with adhesive bonding of the finger pull to only one face of the panel. However, since pressure sensitive adhesives bond to the panel on contact and prevent sliding, they cannot be used in finger pulls of the type having channel-shaped mounting portions which must slide into position on the edge of a panel.

SUMMARY OF THE INVENTION

It is an object of the present invention to provide a finger pull which is adapted for attachment to intersecting relatively transverse side and edge faces of a glass panel or the like with pressure sensitive adhesive.

Accordingly, the present invention provides a finger pull for attachment to intersecting relatively transverse side and edge faces of a panel comprising a unitary body of a synthetic resin material of a type that is bendable without breaking in this sections and generally rigid in thick sections, the body including a main base portion and an auxiliary base portion integrally connected along one edge to one edge of the main base portion by a thin connecting portion. The main base portion has a generally flat mounting face at one side and a handle extending from its outer side, and the auxiliary base portion has a generally flat mounting face disposed coplanar with the mounting face of the main base portion. A strip of pressure sensitive adhesive has one side adhered to the mounting faces of the main base portion and the auxiliary base portion and a removable cover material covers the other side of the pressure sensitive adhesive. The thin connecting portion is sufficiently thin to bend without breaking and allow the auxiliary base portion to be moved relative to the main base portion to a position in which the mounting face of the auxiliary base portion extends perpendicular to the mounting face of the main base portion. After removal of the cover material from the pressure sensitive adhesive, one of the base portions can be secured by the pressure sensitive adhesive on its mounting face to one of two intersecting faces of a panel and the other face portion then moved to a transverse position to be secured by the pressure sensitive adhesive on its mounting face to the other of the two intersecting faces of the panel.

BRIEF DESCRIPTION OF THE DRAWINGS

FIG. 1 is a fragmentary perspective view illustrating a finger pull embodying the the present invention mounted on a sliding glass panel;

FIG. 2 is an end elevational view of the finger pull;

FIG. 3 is a front view of the finger pull; and

FIG. 4 is a fragmentary sectional view through the finger pull and glass panel illustrating mounting of the finger pull on the intersecting relatively transverse side and edge face of the panel.

DETAILED DESCRIPTION

The finger pull of the present invention is adapted for mounting on intersecting relatively transverse side and edge faces herein designated 10*a* and 10*b* of a panel 10. It is particularly adapted for use in mounting on the intersecting upright side and end faces of sliding glass panels to facilitate movement of the panels along trackways 11, to open and close the same.

The finger pull designated generally by the numeral 12 comprises a unitary body formed of a synthetic resin material of a type that is bendable without breaking in thin sections and generally rigid in thick sections. The finger pull may, for example, be formed of a polycarbonate material. It will be understood by those skilled in the art that other synthetic resin materials having the characteristics referred to above, could be utilized.

The body 12 of the finger pull includes a main base portion 13 and an auxiliary base portion 14 that is integrally connected along one edge to one edge of the main base portion by a thin connection portion 15. The main base portion has a generally flat mounting face 13*a* at one side and an outer face 13*b*, and a handle portion 16 extends laterally from the main base portion. The auxiliary base portion 14 has a mounting face 14*a* at one side and an outer face 14*b* at its other side, and when the finger pull body is formed, the mounting face 14*a* of the auxiliary base portion is disposed coplanar with the mounting face 13*a* of the main base portion, as shown in FIG. 2.

The handle portion 16 is provided on the main base portion 13 and the main base portion and handle portion are formed with a sufficiently thick section to provide a relatively rigid structure. The auxiliary base portion 14 is also formed with a sufficiently thick section to be relatively rigid and the connection portion 15 is made sufficiently thin to bend without breaking and allow the auxiliary base portion to be moved relative to the main base portion to a position in which its mounting face extends perpendicular to the mounting face of the main base portion. As best shown in FIG. 2, the adjacent edges of the outer faces 13*b*, 14*b* of the main and auxiliary base portions converge in a direction toward the thin connecting portion 15 to form a generally V-shaped notch therebetween when the mounting faces of the main and auxiliary base portions are coplanar, and the thin connecting portion is disposed adjacent the plane of the mounting faces. The converging adjacent edges of the main and auxiliary base portions are preferably radiused as shown in FIG. 2, to form a generally rounded outer corner when the finger pull is mounted on panel 10 as shown in FIG. 4.

In the preferred embodiment illustrated, the main base portion 13 has a generally rectangular cross section and the handle portion 16 extends laterally from the base portion at an edge remote from the edge that is joined by the connecting portion 15 to the auxiliary base portion 14. The auxiliary base portion 14 has a width not substantially greater than the thickness of the glass on which it is to be used. The finger pull shown herein is conveniently formed by extruding a strip of the synthetic resin material having a cross section as shown in FIG. 2, and then cutting off sections of the extrusion along lines perpendicular to its length to form individual finger pulls. Alternatively, the finger pull could be formed by injection molding.

A strip of pressure sensitive adhesive 18 is adhered on one side to the mounting faces 13*a* and 14*a* of the main and auxiliary base portions, and a removable cover 19 of a material treated to be peelable, covers the outer side of the pressure sensitive adhesive. Pressure sensitive adhesive transfer tapes in which a layer of pressure sensitive adhesive is supplied on a strip of peelable cover material, are preferably used to provide the adhesive strip 18 and cover 19. The pressure sensitive adhesive transfer tape may, for example, be of the type sold by Minnesota Mining and Manufacturing Company of Minneapolis, Minnesota under the brand name "Isotac". The pressure sensitive adhesive and covering material are applied to the mounting faces of the main and auxiliary base portions while they are coplanar, as shown in FIG. 2.

The protective cover material 19 is removed from the layer of pressure sensitive adhesive prior to mounting and one of the base portions is secured by its pressure sensitive adhesive to one of two intersecting faces of the panel and, the other base portion then moved to a transverse position to be secured by its pressure sensitive adhesive to the other of the two intersecting faces of the panel. For example, the mounting face 13*a* of the base portion 13 can be pressed onto the side face 10*a* of the panel 10 at a location to position the connecting portion 15 along the edge juncture of the side and edge faces of the panel, and the auxiliary base portion then bent to a position as shown in FIG. 4 in which its side face is adhered to the edge face 10*b* of the panel. It is apparent that the above procedure could be reversed with the auxiliary base portion first being attached to the edge of the panel and the main base portion thereafter moved relative to the auxiliary base portion to a position in which the pressure sensitive adhesive on its mounting face engages the side face of the panel. Alternatively, the main and auxiliary base portions could be angulated slightly relative to each other to form an open V-notch between the mounting faces which notch could be then aligned with the edge of the panel and the auxiliary and main base portions thereafter pressed either sequentially or simultaneously against the respective faces on the panel.

From the foregoing it will be seen that the finger pull is secured by pressure sensitive adhesive to the intersecting relatively transverse side and end faces of the panel and provides a secure attachment of the finger pull to the panel. The auxiliary base portion is secured by pressure sensitive adhesive to the edge face of the panel and inhibits separation of the main base portion from the side face of the panel, under the forces applied to the main base portion through the laterally extending handle 16. Since the finger pull is adhered by pressure sensitive adhesive to the face and edge of the panel, there is no problem in fitting the finger pulls to glass panels of different thickness. The finger pull can be economically formed by extrusion or by molding, and, since the mounting faces of the main and auxiliary base portions are coplanar when initially formed, the pressure sensitive adhesive can be readily applied in flat section or strip form.

The embodiments of the invention in which an exclusive property or privilege is claimed are defined as follows:

1. A finger pull for attachment to intersecting relatively transverse side and edge faces of a panel or the like comprising, a unitary body of a synthetic resin material of a type that is bendable without breaking in thin sections and generally rigid in thick sections, the body including a main base portion and an auxiliary base portion integrally connected along one edge to one edge of the main base portion by a thin connection portion, the main base portion having a generally flat mounting face at one side and an outer face at a side opposite the mounting face and a handle portion extending laterally from the outer face of the main base portion at the side opposite the mounting face, the auxiliary base portion having a generally flat mounting face disposed coplanar with the mounting face of the main base portion and an outer face at a side opposite its mounting face, a strip of pressure sensitive adhesive having one side adhered to the mounting faces of the main base portion and the auxiliary base portion and a removable cover material covering its other side, the main and auxiliary base portions having sufficiently thick cross sections to be generally rigid and the thin connecting portion being sufficiently thin to bend without breaking and allow the auxiliary base portion to be moved relative to the main base portion to a position in which the mounting face of the auxiliary base portion extends perpendicular to the mounting face of the main base portion whereby, after removal of the cover material, one of the base portions can be secured by the pressure sensitive adhesive on its mounting face to one of two intersecting faces of the panel and the other base portion then moved into a transverse position to be secured by its pressure sensitive adhesive on the mounting face to the other of the two intersecting faces of the panel.

2. A finger pull according to claim 1 wherein said flexible connecting portion is disposed adjacent the mounting face of the main base portion.

3. A finger pull according to claim 2 wherein the outer face of the main base portion has a portion along said one edge thereof that converges relative to its mounting face in a direction toward said connecting portion.

4. A finger pull according to claim 1 wherein the outer faces of the main and auxiliary base portions define a generally V-shaped recess therebetween when their mounting faces are coplanar.

5. A finger pull according to claim 1 wherein the handle portion extends laterally of the outer face of the main base portion adjacent a second edge of the main base portion that parallels said one edge of the main base portion.

* * * * *